US007097041B2

(12) United States Patent
Marrale

(10) Patent No.: US 7,097,041 B2
(45) Date of Patent: Aug. 29, 2006

(54) CONVERTIBLE SHIPPER CONTAINER

(75) Inventor: Bruce A. Marrale, Wildwood, MO (US)

(73) Assignee: Ralcorp Holding, Inc., St. Louis, MO (US)

( * ) Notice: Subject to any disclaimer, the term of this patent is extended or adjusted under 35 U.S.C. 154(b) by 310 days.

(21) Appl. No.: 10/627,078

(22) Filed: Jul. 25, 2003

(65) Prior Publication Data

US 2005/0016891 A1 Jan. 27, 2005

(51) Int. Cl.

| | |
|---|---|
| ***B65D 5/54*** | (2006.01) |
| ***B65D 25/54*** | (2006.01) |
| ***B65D 5/00*** | (2006.01) |
| ***B65D 17/00*** | (2006.01) |

(52) U.S. Cl. ..... 206/736; 206/769; 229/103; 229/243; 229/244

(58) Field of Classification Search ..... 206/736, 206/769, 774, 525.1; 229/103, 122, 162.1, 229/162.6, 200, 235, 238, 240, 241, 243, 229/244

See application file for complete search history.

(56) References Cited

U.S. PATENT DOCUMENTS

| | | | | |
|---|---|---|---|---|
| 3,812,958 | A * | 5/1974 | Samsing | 206/526 |
| 4,058,206 | A * | 11/1977 | Morse et al. | 229/241 |
| 4,865,187 | A * | 9/1989 | Zulauf et al. | 206/772 |
| 4,961,501 | A * | 10/1990 | Hansmann | 206/429 |
| 5,415,343 | A * | 5/1995 | Vosbikian | 229/162.3 |
| 5,651,497 | A * | 7/1997 | Ventura et al. | 229/235 |
| 6,073,833 | A * | 6/2000 | Desrosiers et al. | 229/235 |
| 6,510,982 | B1 * | 1/2003 | White et al. | 229/235 |
| 6,554,135 | B1 * | 4/2003 | Luceri et al. | 206/526 |
| 2004/0163994 | A1 * | 8/2004 | Gardner et al. | 206/736 |

FOREIGN PATENT DOCUMENTS

GB 2088830 A * 6/1982

* cited by examiner

*Primary Examiner*—Mickey Yu
*Assistant Examiner*—J. Gregory Pickett
(74) *Attorney, Agent, or Firm*—Harness, Dickey & Pierce, P.L.C.

(57) ABSTRACT

A convertible shipper container used for shipping and displaying packaged products. The shipper includes a top panel, a bottom panel and a partially open front side. The shipper additionally includes a first side including a first slot therethrough and a first portion of a separation strip included therein. The shipper further includes a back panel including a second portion of the separation strip included therein and a second side including a second slot therethrough and a third portion of the separation strip included therein.

16 Claims, 5 Drawing Sheets

CONVERTIBLE SHIPPER CONTAINER

FIELD OF INVENTION

This invention relates generally to containers used to package a product to be shipped from one location to another, commonly known as shipper containers, and specifically, to a shipper container that can be easily converted to a display tray suitable for presentation at a point of sale.

BACKGROUND OF THE INVENTION

All sorts of goods or products are shipped to retail outlets in shipper containers constructed to hold a plurality of individual units, i.e. goods, packages or boxes. Such shipper containers hold the units firmly in place and protect the units from being damaged during shipping. Typically, to present the units at the point of sale, the individual units are removed from the shipper container and transferred to a shelf or separate display container. This involves the manual removing of each unit from the shipper container and placing it on the shelf or display container. To reduce the extra handling involved and the extra display containers required, at least one known shipper container also serves as a display container.

Generally, transforming the shipper container into a display container involves the removal of a portion of the container to expose the contents enclosed. One such shipper container comprises a two piece container having a body and lid. This two piece design is labor intensive to manufacture, uses excessive material and typically requires some mechanism to hold the lid on the body during shipping, for example a strap or tie wrap. Other such shipper containers comprise containers having a piece of separation tape included or embedded that is torn from the container to separate the container into two sections or containers having a tear strip that is torn away to separate the container into two sections. Although these types of shipper containers can be converted to display containers, the edges of the display containers generally have rough, unfinished, jagged, and uneven surfaces that are somewhat unsightly and do not provide the appeal of a neat, clean and presentable display.

It would therefore be desirable to provide a convertible shipper container that can be fabricated efficiently, economically and which can be converted into display container having a neat, clean appearance.

BRIEF SUMMARY OF THE INVENTION

In one preferred embodiment of the present invention, a convertible shipper container is provided for shipping and displaying packaged products. The shipper container includes a top panel, a bottom panel and a partially open front side. The shipper container additionally includes a first side including a first slot therethrough and a first portion of a separation strip included therein, a back panel including a second portion of the separation strip included therein, and a second side including a second slot therethrough and a third portion of the separation strip included therein.

In another preferred embodiment of the present invention, a production blank is provided for forming a convertible shipper container to ship and display packaged products. The blank includes a first section including a top panel, a first side primary flap connected to the top panel along a top first side fold line, and a second side primary flap connected to the top panel along a top second side fold line. The blank additionally includes a second section connected to the first section along a first major fold line. The second section includes a back panel, a first side secondary flap connected to the back panel along a back first side fold line, a second side secondary flap connected to the back panel along a back second side fold line, and a separation strip included therein. A first portion of the separation strip is included in the first side secondary flap, a second portion of separation strip is included in the back panel, and a third portion of the separation strip is included in the second side secondary flap.

The blank further includes a third section connected to the second section along a second major fold line. The third section includes a bottom panel, a first side tertiary flap connected to the bottom panel along a bottom first side fold line, and second side tertiary flap connected to the bottom panel along a bottom second side fold line. Further yet, the blank includes a forth section connected to the third section along a third major fold line, the forth section including a front wall, a first side quaternary flap connected to the front wall along a front wall first side fold line, and a second side quaternary flap connected to the front wall along a front wall second side fold line. A front edge of the first side primary flap, a front edge of the top panel, a front edge of the second side primary flap, and a top edge of the front wall form a window in a partially open front side of the convertible shipper container formed from the blank.

Shipper containers in accordance with various embodiments of the present invention provide a shipper container of simple and inexpensive construction, that holds and protects product during storage and shipment but which can quickly and easily be converted into a presentable display tray. This conversion preferably can be accomplished in a single step, without the need for special tools.

BRIEF DESCRIPTION OF THE DRAWINGS

The present invention will become more fully understood from the detailed description and accompanying drawings, wherein.

Corresponding reference numerals indicate corresponding parts throughout the several views of the drawings.

DETAILED DESCRIPTION OF THE INVENTION

Reference now will be made to the embodiments of the invention, one or more examples of which are set forth below. Each example is provided by way of explanation of the invention, not as a limitation of the invention. In fact, it will be apparent to those skilled in the art that various modifications and variations can be made in this invention without departing from the scope or spirit of the invention. For instance, features illustrated or described as part of one embodiment can be used on another embodiment to yield a still further embodiment. Thus, it is intended that the present invention cover such modifications and variations as come within the scope of the appended claims and their equivalents.

Figure 1:
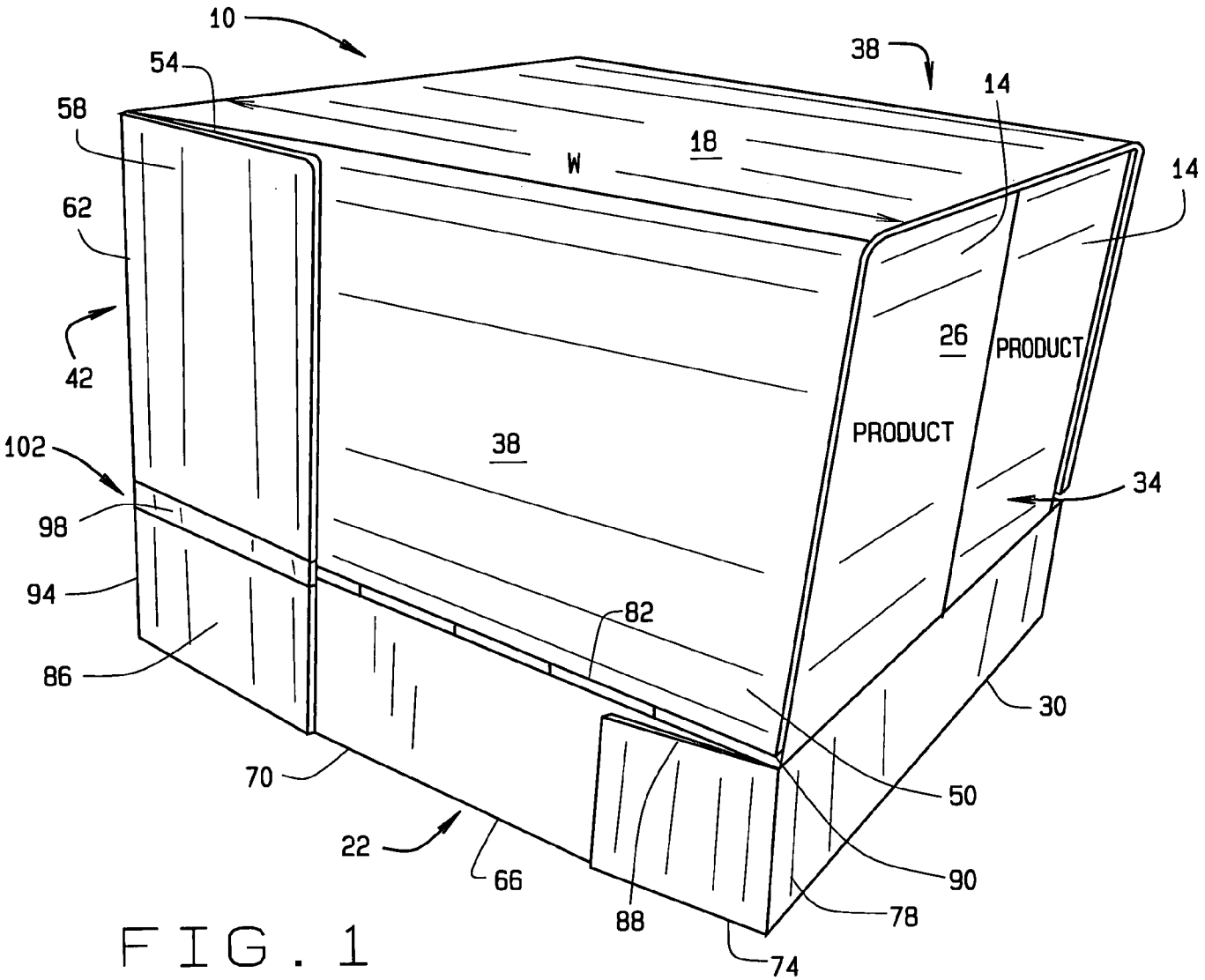
FIG. 1 is a left-side perspective view of a convertible shipper container, in accordance with a preferred embodiment of the present invention.

FIG. 1 is a perspective view of a convertible shipper container 10, in accordance with one preferred embodiment of the present invention. The container 10 is adapted to retain and protect at least one product 14 during shipping of the product 14 to a desired location. The container 10 is further adapted to be converted to a display tray suitable for presentation of the product 14 at a point of sale at the desired location. Although the product 14 is shown in FIG. 1 as a box, the term product is used herein to mean any type of good, package or box that is suitable for packaging, shipping and displaying in the container 10. In one preferred embodiment, the container 10 is constructed of corrugated cardboard. Alternatively, the container 10 can be constructed of any other suitable material such as paperboard, plastic, or pressed foam.

The container 10 includes a top panel 18, a bottom panel 22 and a partially open front side 26. The partially open front 26 includes a front wall 30 and a window 34. The container additionally includes a left side 38, a back panel 42 and a right side 46. In the preferred embodiment, the left side 38 includes a first side primary flap 50 that is connected to the top panel 18 along a top left side fold line 54 and a left side secondary flap 58 connected to the back panel 42 along a back left side fold line 62. The left side 38 additionally includes a left side tertiary flap 66 connected to the bottom panel 22 along a bottom left side fold line 70 and a left side quaternary flap 74 connected to the front wall 30 along front left side fold line 78. The left side 38 is formed by folding the left side primary flap 50 along the top left side fold line 54 and folding the left side tertiary flap 66 along bottom left side fold line 70. The left side secondary flap 58 and the left side quaternary flap 74 are then folded along fold lines 62 and 78, respectively. The left side secondary flap 58 is attached to the left side primary flap 50 and the left side tertiary flap 66 using a suitable bonding means. For example, the bonding means can be glue, chemical adhesive, hot melt or tape or a fastener, such as a staple. Likewise, the left side quaternary flap 74 is attached to the left side tertiary flap 66 using the bonding means.

The dimensions of the left side primary flap 50, the left side tertiary flap 66 and the left side quaternary flap 74 are preferably such that when folded along the respective fold lines 54, 70 and 78, the left side primary flap 50 does not overlap the left side tertiary and quaternary flaps 66 and 74. More specifically, when the left side primary, tertiary and quaternary flaps 50, 66 and 74 are folded along their respective fold lines 54, 70 and 78, a lower edge 82 of the left side primary flap 50 is spaced apart from an upper edge 86 of the left side tertiary flap 66 and an upper edge 88 of the left side quaternary flap 74. This spaced apart relationship of the lower edge 82 and upper edges 86 and 88 forms a first slot 90 in the assembled container that extends partially across a width W of the left side 38. The left side secondary flap 58 includes a first portion 94 of a separation strip 98. When left side secondary flap 58 is folded along fold line 62 to form the left side 38, the first portion 94 of the separation strip 98 extends collinearly with the first slot 90 across the remainder of the width W of the left side 38.

The separation strip 98 can be any suitable means adapted to separate the left side secondary flap 58 into two portions. For example, the separation strip 98 can be a tear strip formed by perforations in the left side secondary flap 58. Such a tear strip would be pulled at one end such that the secondary flap 58 is torn along the perforations and the secondary flap 58 is separated into two portions. As a further example, the separation strip 98 can be a strip of Sesame® tape embedded in the first side secondary flap 58. In this instance the Sesame® tape would be removed by pulling an end of the Sesame® tape such that the Sesame® tape is torn from the secondary flap 58, thereby separating the secondary flap 58 into two portions. Additionally, the back panel 42 includes a second portion 102 of the separation strip 98 that is likewise adapted to separate the back panel 42 into two portions upon removal of the separations strip 98. The second portion 102 of the separation strip 98 is more clearly shown in FIG. 4, described below.

Figure 2:
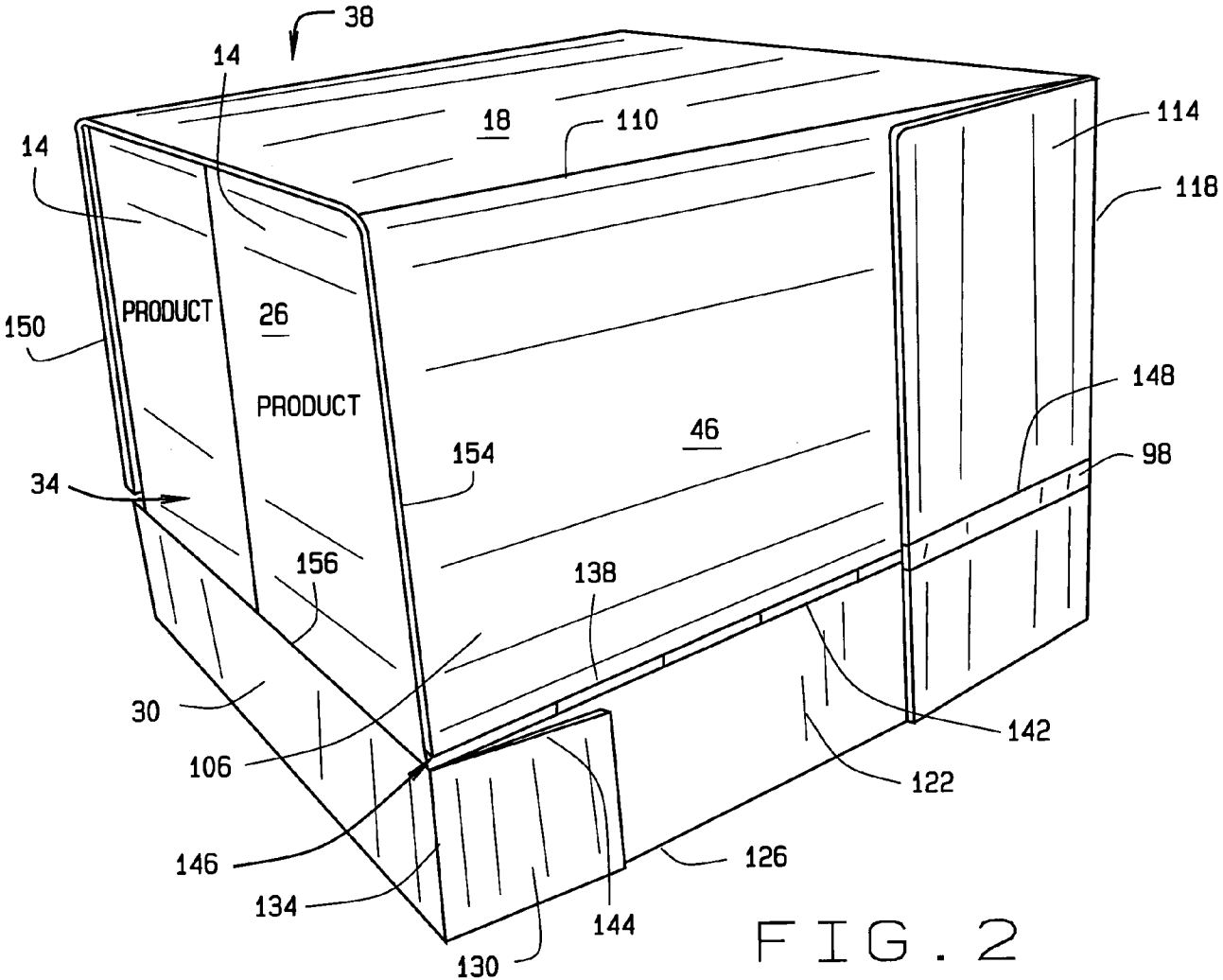
FIG. 2 is a right-side perspective view of the convertible shipper container shown in FIG. 1.

FIG. 2 is another perspective view of the convertible container 10 showing the right side 46. The right side 46 includes a right side primary flap 106 that is connected to the top panel 18 along a top right side fold line 110 and a right side secondary flap 114 connected to the back panel 42 along a fold line 118. The right side 46 additionally includes a right side tertiary flap 122 connected to the bottom panel 22 along a fold line 126 and a right side quaternary flap 130 connected to the front wall 30 along fold line 134. The right side 46 is formed by folding the right side primary flap 106 along the fold line 110 and folding the right side tertiary flap 122 along fold line 126. The right side secondary flap 114 and the right side quaternary flap 130 are then folded along fold lines 118 and 134, respectively. The right side secondary flap 114 is attached to the right side primary flap 106 and the right side tertiary flap 122 using any bonding means as described above. Likewise, the right side quaternary flap 130 is attached to the right side tertiary flap 122 using any suitable bonding means, as described above.

The dimensions of the right side primary flap 106, the right side tertiary flap 122 and the right side quaternary flap 130 are such that when folded along the respective fold lines 110, 126 and 134, the right side primary flap 106 does not overlap the right side tertiary and quaternary flaps 122 and 130. More specifically, when the right side primary, tertiary and quaternary flaps 106, 122 and 130 are folded along the respective fold lines 110, 126 and 134, a lower edge 138 of the right side primary flap 106 is spaced apart from an upper edge 142 of the right side tertiary flap 122 and an upper edge 144 of the right side quaternary flap 130. This spaced apart relationship of the lower edge 138 and upper edges 142 and 144 forms a second slot 146 in the assembled container that extends partially across the width W of the second side 46. The right side secondary flap 114 includes a third portion 148 of the separation strip 98. When right side secondary flap 114 is folded along fold line 118 to form the second side 46, the third portion 148 of the separation strip 98 extends collinearly with the second slot 146 across the remainder of the width W of the second side 46.

Once the container 10 is formed, the window 34 has a perimeter formed by a front edge 150 of the first side primary flap 50, a front edge 152 of the top panel 18, a front edge of the second side primary flap 106, and an upper edge 156 of the front wall 30.

Figure 3:
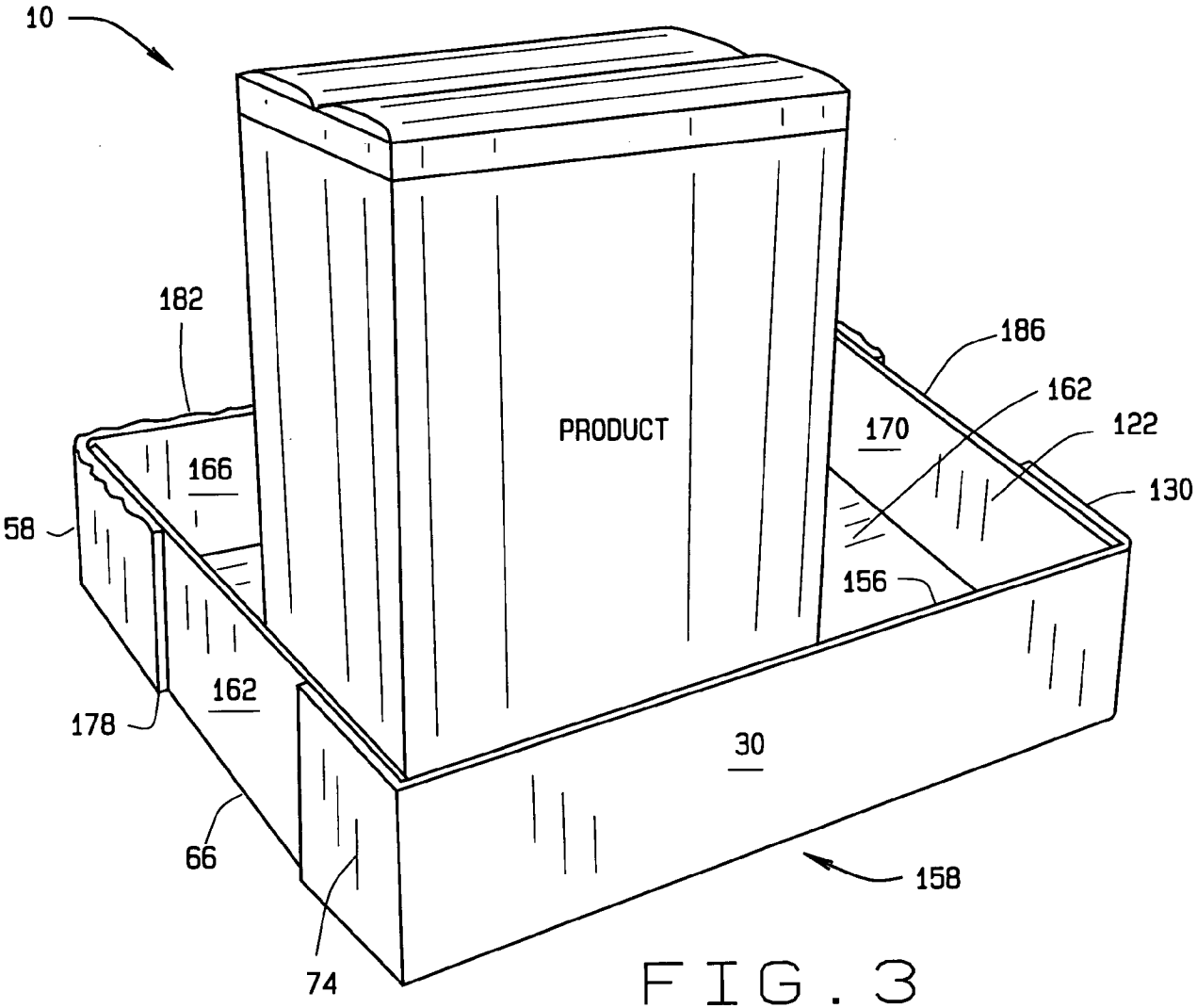
FIG. 3 is a front perspective view of the convertible shipper container shown in FIG. 1, after conversion to a display tray.

FIG. 3 is a perspective view of the container 10 after it has been converted to a display portion 158 of the convertible shipper container 10 (shown in FIGS. 1 and 2). Once the container 10 and the enclosed product 14 arrive at a desired destination, the container can be separated into the display portion 158 and a disposable portion (not shown). The container 10 is converted to the display portion 158 by removing the separations strip 98 (shown in FIGS. 1 and 2) from the left side secondary flap 58, the back panel 42 and the right side secondary flap 114. The separation strip 98 is preferably removed by grasping one end of the separation strip 98 and pulling the separation strip 98 so that the separation strip 98 separates from the container 10. For example, an end of the first portion 94 of the separation strip 98 can be grasped and pulled such that the separation strip 98 is torn from the first side secondary flap 58. Continuing to pull the separation strip 98 will then tear the second portion 102 of the separation strip 98 from the back panel 42 and the third portion 148 from the second side secondary flap 114. Thus, removing the separation strip 98 will separate the container 10 into the disposable portion that can be discarded and the display portion 158 that can be utilized to display the enclosed products 14 at the point of sale.

The display portion 158 includes the bottom panel 22, the front wall 30, a left side wall 162, a back wall 166, and a right side wall 170. The left side wall 162 includes the left side tertiary flap 66, the left side quaternary flap 74, and the portion of the left side secondary flap 58 remaining after the first portion 94 of the separation tape 98 has been removed. The back panel wall 166 is comprised of the portion of back panel 42 remaining after the second portion 102 of the separation tape 98 has been removed. The right side wall 170 includes the right side tertiary flap 122, the right side quaternary flap 130, and the portion of the right side secondary flap 114 remaining after the first portion 94 of the separation tape 98 has been removed. Additionally, the front wall 30 includes an upper edge 156, the left side wall 162 includes an upper edge 178, the back wall includes an upper edge 182 and the right side wall includes an upper edge 186.

The front wall upper edge 174 is preferably a fabricated edge having a straight, uniform manufactured surface that is clean and neat. The left side wall upper edge 178 includes a section adjacent the front having a uniform manufactured finished edge and a section adjacent the rear with an unfinished edge resulting from the first portion 94 of the separation strip 98 being removed from the left side secondary flap 58. The lengths of the sections of the left side wall upper edge 178 having an unfinished edge and a finished edge are dependant on the dimensions of the left side secondary flap 58. In one preferred embodiment, the left side secondary flap 58 extends approximately one-third of the width W across the left side 38 (shown in FIG. 1). Therefore, the length of the section of the left side wall upper edge 178 having an unfinished edge is approximately one-third of the width W, while the length of the section having the finished manufactured surface is approximately two-thirds of the width W.

The back wall upper edge 182 has an unfinished surface resulting from the removal of the second section of the separation strip 98 from the back panel 42 (shown in FIG. 1). Similar to the left side wall upper edge 178, the right side wall upper edge 186 includes a section having a uniform manufactured finished edge and a section with an unfinished edge. The section having the unfinished edge results from the third portion 148 of the separation strip 98 being removed from the right side secondary flap 114. The section of the right side wall upper edge 186 having the unfinished edge extends partially across the upper edge 186 and the section having the uniform manufactured finished edge extends across the remainder of the right side wall upper edge 186. The lengths of the sections of the right side wall upper edge 186 having the unfinished edge and the uniform manufactured finished edge are dependant on the dimensions of the right side secondary flap 114. In one preferred embodiment, the right side secondary flap 114 extends approximately one-third of the width W across the right side 46 (shown in FIG. 2). Therefore, the length of the section of the right side wall upper edge 186 having the unfinished surface is approximately one-third of the width W, while the length of the section having the uniform manufactured finished edge is approximately two-thirds of the width W. The uniform manufactured finished edges of the front wall upper edge 156, the left side wall upper edge 178 and the right side wall upper edge 186, provide the display portion 158 with a neat, clean appearance. Such a neat, clean appearance creates an appealing, attractive display at the point of sale.

In various preferred embodiments, the front wall 30, and the left side wall 162, the back wall 166, and the right side wall 170 have uniform heights across their respective widths. In one such preferred embodiment, the heights of the front wall 30, the left side wall 162, the back wall 166, and the right side wall 170 are equal. In another such preferred embodiment the heights of at least two of the front wall 30, the left side wall 162, the back wall 166 and the right side wall 170 are equal. In a preferred alternative embodiment the front wall 30 and the back wall 166 each have a uniform, but different heights across their respective widths, with the front wall being lower than the back wall. The left side wall upper edge 178 slopes upwardly from a first end of the front wall upper edge 156 to a first end of the back wall upper edge 182. Likewise, the right side wall upper edge 186 slopes from a second end of the front wall upper edge 156 to a second end of the back wall upper edge 182.

Figure 4:
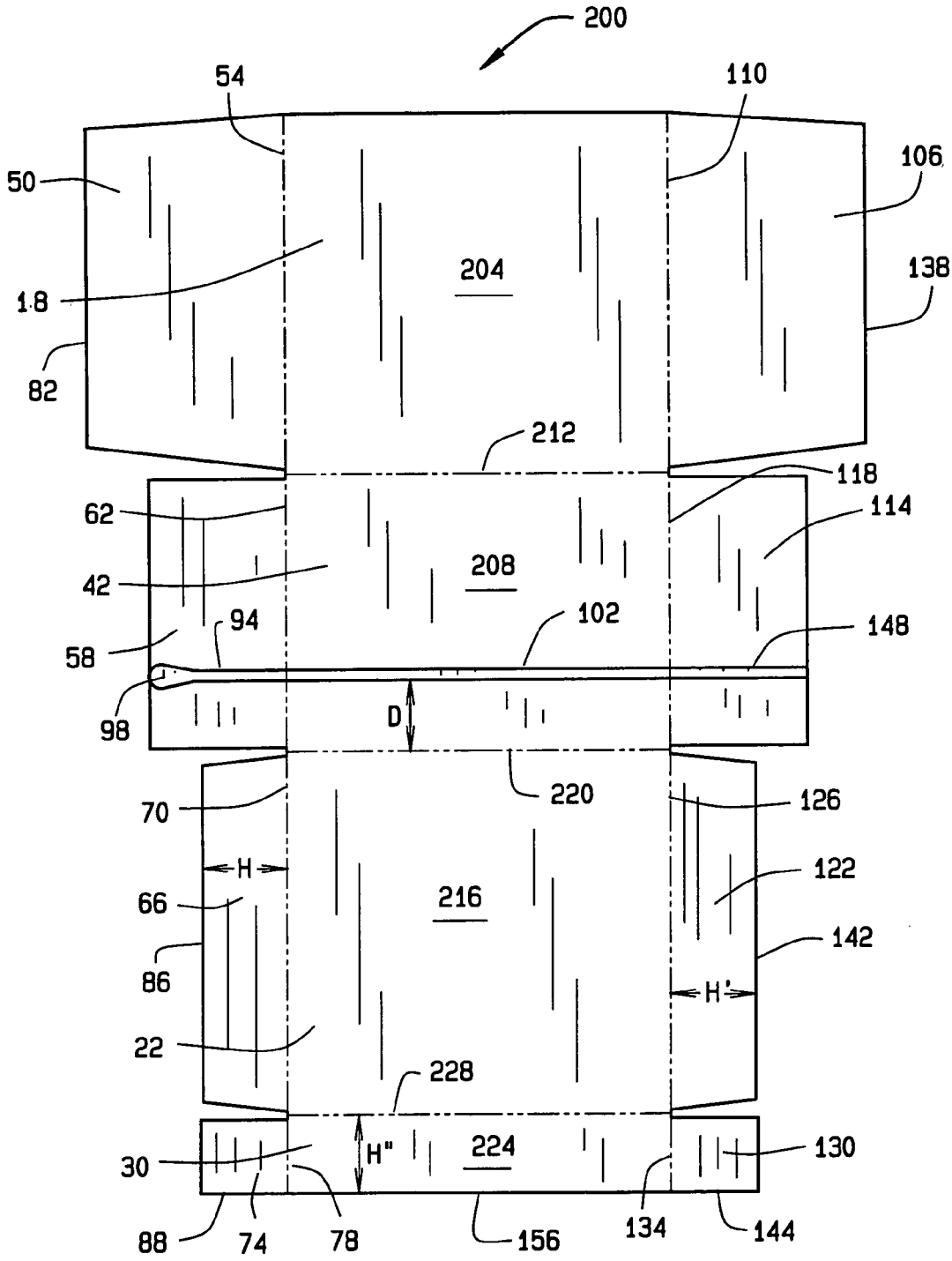
FIG. 4 is plan view of a production blank used to form the convertible shipper shown in FIG. 1.

FIG. 4 is a plan view of a production blank 200 for making a convertible shipper container 10 (shown in FIGS. 1, 2 and 3) in accordance with the principles of this invention. Corresponding parts between the container 10 shown in FIGS. 1–3 and the blank shown in FIG. 4 are identified with corresponding reference numerals. The blank 200 includes a first section 204 that includes the top panel 18, the left side primary flap 50 connected to the top panel 18 along the top left side fold line 54, and the right side primary flap 106 connected to the top panel 18 along the top right side fold line 110. The blank 200 additionally includes a second section 208 connected to the first section 204 along a first major fold line 212. The second section 208 includes the back panel 42, the left side secondary flap 58 connected to the back panel 42 along the back left side fold line 62 and the right side secondary flap 114 connected to the back panel 42 along the back right side fold line 118. Additionally, the second section 208 includes the separation strip 98 having the first portion 94 included in the left side secondary flap 58, the second portion 102 included in the back panel 42, and the third portion 148 included in the right side secondary flap 114.

The blank 200 further includes a third section 216 connected to the second section 208 along a second major fold line 220. The third section 216 includes the bottom panel 22, the left side tertiary flap 66 connected to the bottom panel 22 along a bottom left side fold line 70, and the right side tertiary flap 122 connected to the bottom panel 22 along the bottom right side fold line 126. Further still, the blank 200 includes a forth section 224 connected to the third section 216 along a third major fold line 228. The forth section 224 includes the front wall 30, the left side quaternary flap 74 connected to the front wall along the front wall left side fold line 78, and the right side quaternary flap 130 connected to the front wall 30 along the front wall right side fold line 134.

In one preferred embodiment, the container 10 is formed by first folding the blank 200 along the first and second major fold lines 212 and 220 so that the top panel 18 and the bottom panel 22 form generally parallel planes. The left side primary and tertiary flaps 50 and 66 are then folded inward. The left side primary and tertiary flaps 50 and 66 are dimensioned such that they do not overlap. Rather, the left side primary flap lower edge 82 and the left side tertiary flap upper edge 88 have a spaced apart relationship. Next the left side secondary flap 58 is folded inward and attached to the left side primary and tertiary flaps 50 and 66. At this point the product 14 can be placed in the partially formed container 10. Alternatively, the product 14 can be placed on the bottom panel 22 prior to starting to form the container 10 from the blank 200, or any other suitable time during the formation of the container 10. The front wall 30 is then folded along the third major fold line 228 and the left side quaternary flap 74 is folded inward and attached to the left side tertiary flap 66. Once the left side quaternary flap 74 is attached to the left side tertiary flap 66, the left side 38 is formed.

The dimensions of the front wall 30 are such that the upper edge 88 of the left side quaternary flap 74 is essentially even with the upper edge 86 of the left side tertiary flap 66. Thus, the left side quaternary flap upper edge 88 has essentially the same spaced apart relationship with the left side primary flap lower edge 82 as does the left side tertiary flap upper edge 86. The spaced apart relationship of the left side primary flap lower edge 82 with the left side tertiary flap and quaternary flap upper edges 86 and 88 form the first slot 90 that extends partially across the width W of the left side 38. Additionally, location of the first portion 94 of the separation strip 98 within the left side secondary flap 58 aligns the first portion 94 with the first slot 90 such that it extends collinearly with the first slot 90 across the remaining portion of the width W of the first side 38.

Once the left side 38 is formed, the right side 46 can be formed (of course, the right side could be assembled prior to, or at the same time as, the left side 38). The right side primary and tertiary flaps 106 and 122 are folded inward. Similar to the left side primary and tertiary flaps 50 and 66, the right side primary and tertiary flaps 106 and 122 are dimensioned such that the right side primary flap lower edge 138 and the right side tertiary flap upper edge 142 have a spaced apart relationship. The right side secondary flap 114 is then folded inward and attached to the right side primary and tertiary flaps 106 and 122. The right side quaternary flap 144 is then folded inward and attached to the right side tertiary flap 122. Once the right side quaternary flap 144 is attached to the right side tertiary flap 122, the right side 46 is formed and the container 10 is completed.

The dimensions of the front wall 30 are such that the upper edge 144 of the right side quaternary flap 130 is essentially even with the upper edge 142 of the right side tertiary flap 122. Thus, the right side quaternary flap upper edge 144 has essentially the same spaced apart relationship with the right side primary flap lower edge 138 as does the right side tertiary flap upper edge 142. The spaced apart relationship of the right side primary flap lower edge 138 with the right side tertiary flap and quaternary flap upper edges 142 and 144 form the second slot 146 that extends partially across the width W of the right side 46. The spaced apart relationship of the right side primary flap lower edge 138 and the right side tertiary flap upper edge 142 form the second slot 146 that extends partially across the width W of the right side 46. Additionally, the location of the third portion 148 of the separation strip 98 within the right side secondary flap 114 aligns the third portion 148 with the second slot 146 such that third portion 148 extends collinearly with the second slot 146 across the remaining portion of the width W of the right side 46.

When the convertible shipper container 10 is completely formed around the product 14, the product 14 is viewable via the window 34 (shown in FIGS. 1 and 2). The window 34 is framed by the front edge 150 of the left side primary flap 50, the front edge 152 of the top panel 18, the front edge 154 of the right side primary flap 106, and the top edge 156 of the front wall 30. Once the container 10 with the product 14 enclosed is shipped to the desired location, the separation strip 98 can be removed to convert the container 10 from a shipper container to a display container, i.e. the display portion 158.

As can be seen in FIG. 4, the left and right side tertiary flap upper edges 86 and 142, the left and right side quaternary flap upper edges 88 and 144, and the front wall upper edge 156 are all fabricated edges having a uniform manufactured finished edge. Therefore, when the separation strip 98 is removed from the formed container 10, the left side wall upper edge 178 will have a section with a uniform manufactured finished edge and a section with a unfinished edge. The section of the left side wall upper edge 178 with the uniform manufactured finished edge results from the upper edges 86 and 88 of the left side tertiary and quaternary flaps 66 and 74, respectively. The section of the left side wall upper edge 178 with the unfinished edge results from the first portion 94 of the separation strip 98 being removed from the left side secondary flap 58.

Likewise, the right side wall upper edge 186 will have a section with a uniform manufactured finished edge and a section with a unfinished edge. The section of the right side wall upper edge 186 with the uniform manufactured finished edge results from the upper edges 142 and 144 of the right side tertiary and quaternary flaps 122 and 130, respectively. The section of the right side wall upper edge 186 with the unfinished edge results from the third portion 148 of the separation strip 98 being removed from the right side secondary flap 114. As can also be seen in FIG. 4, when the second portion 102 of the separation strip 98 is removed from the back panel 42, the resulting back side upper edge 182 will have an unfinished edge.

While the portions of the edges of the display tray formed by the separation strip 98 are described herein as unfinished, this is in comparison to the finished edges, and depending upon the type of separation strip 98 the unfinished edges are still substantially straight and neat and clean in appearance.

In one preferred embodiment the separation strip 98 is located in a straight line, parallel with the second major fold line 220, across the second section 208 of the blank 200. Additionally, the separation strip 98 is located in the second section 208 a distance D from the second major fold line 220 that is approximately equal to a height H of the first side tertiary flap 66. A height H' of the second side tertiary flap 122 and a height H" of the front wall 30 are likewise approximately equal to the height H of the first side tertiary flap 66. Therefore, when the separation strip 98 is removed the remaining display portion 158 will be a display tray with four sides of generally equal height.

In one alternate preferred embodiment, at least two of the heights H, H' and H", and the distance D are equal. For example, the heights H and H', and the distance D are equal such that the left side wall 162, the back wall 166 and the right side wall 170 of the display portion 158 would have equal heights while the front wall 30 would have a lower height. In another alternate embodiment, the heights of the front wall 30 and the back wall 166 are different, and the side walls 162 and 170 slope to transition smoothly between them.

Figure 5:
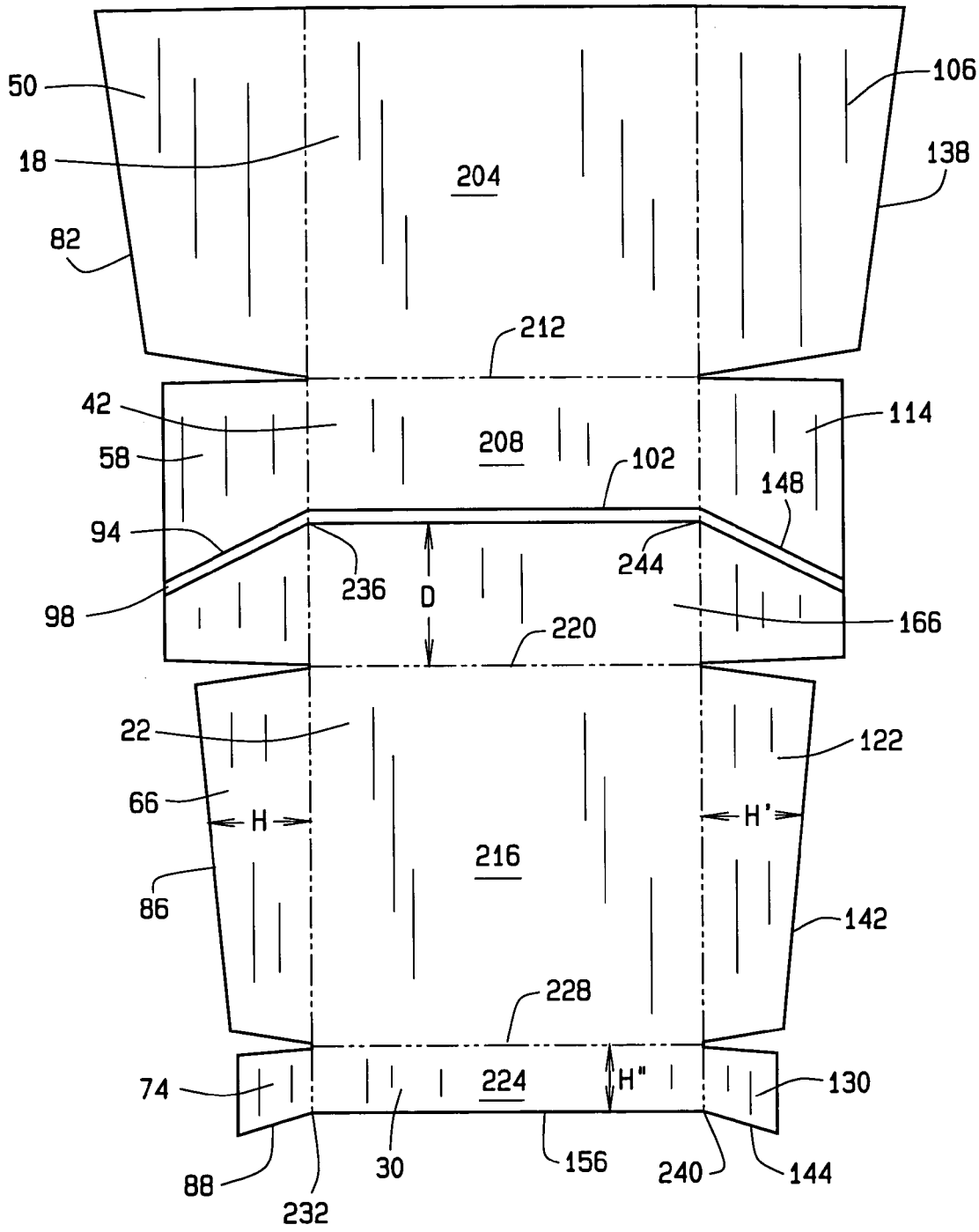
FIG. 5 is a plan view of a production blank used to form a second preferred embodiment of the present invention.

FIG. 5 is an illustration of an alternate preferred embodiment of the production blank 200'. The blank 200' is similar in construction to blank 200 shown in FIG. 4, and corresponding parts are identified with corresponding reference numerals. In this embodiment the separation strip 98 is located in the second section 208 such that the distance D between separation strip second portion 102 and the second major fold line 220 is greater than the height H" of the front wall 30. Additionally, the separation strip first portion 94 is angularly oriented within the left side secondary flap 58 such that the separation strip first portion 94 is not collinear with the separation strip second portion 102. Similarly, the separation strip third portion 148 is angularly oriented within the right side secondary flap 114 such that the separation strip third portion 148 is not collinear with the separation strip second portion 102. Furthermore, the left side tertiary flap 66 is dimensioned such that the height H at the end of the first side tertiary flap 66 attached to the left side quaternary flap 74 is less than the height H at the opposing end of the left side tertiary flap 66.

Likewise, the right side tertiary flap 122 is dimensioned such that the height H' at the end of the right side tertiary flap 122 attached to the right side quaternary flap 130 is less than the height H' at the opposing end of the second side tertiary flap 122. Therefore, after the container 10 is formed and the separation strip 98 is removed, the left side wall top edge 178 will extend from a first end 232 of the front wall top edge 156 diagonally upward to a first end 236 of the back wall top edge 182. Correspondingly, the right side wall top edge 186 will extend from a second end 240 of the front wall top edge 156 diagonally upward to a second end 244 of the back wall top edge 182.

Therefore, as described above the convertible shipper container 10 provides a shipper container with a front display window for providing a view of the enclosed product. Additionally, the shipper container can be converted to a display tray by removing a separation strip included in a portion of each side and across the entire back side of the container. The resulting display tray has a front wall upper edge with a straight, uniform manufactured finished edge. Additionally, the resulting display tray has side walls with upper edges having uniform manufactured finished edges across a relatively large portion of the respective edge and unfinished edges across a remaining smaller portion. Thus, the converted shipper container provides a clean, neat and appealing display tray for presentation of the enclosed product at the point of sale.

While the invention has been described in terms of various specific embodiments, those skilled in the art will recognize that the invention can be practiced with modification within the spirit and scope of the claims.

What is claimed is:

1. A convertible shipper container for shipping and displaying packaged products, the container comprising:

a top panel;

a bottom panel;

a partially open front side;

a left side including a first slot therethrough and a first portion of a separation strip, the left side connected to the top panel, the bottom panel and the front side, a back panel including a second portion of the separation strip, the back panel connected to the top panel, the bottom panel and the right side; and a right side including a second slot therethrough and a third portion of the separation strip, the right side connected to the top panel, the bottom panel, the front side and the back panel;

the separation strip being operable to separate a portion of the left side, back and right side from the container to leave a display portion comprising a bottom with front, back and left and right sidewalls;

the first slot extending at least half of the width [of the respective sides] of the left side and the first portion of the separation strip extending continuously and collinearly with the first slot across a remainder of the width of the left side, and the second slot extending at least halfway across the width of the right side and the third portion of the separation strip extending continuously and collinearly with the second slot across a remainder of the width of the right side.

2. The container according to claim 1 wherein after separation of the separation strip, the front, back and left and right sidewalls of the display portion have the same height.

3. The container according to claim 1 wherein after separation of the separation strip, the back wall of the display portion is higher than the front wall, and the left and right sidewalls slope from the front wall to the back wall.

4. A convertible shipping container for shipping and displaying packaged product, the container comprising:

a bottom panel a top panel;

a front panel having a top end intermediate the top and bottom panel defining a window in the front of the container;

a back panel;

left and right side panels, the side panels each having a slot therein communicating with the window on the front, the slots extending at least half the width of the respective side panels, and a separation strip extending from the end of the slot across one side panel, across the back panel, and across the other side panel to the end of the slot;

the separation strip separating a portion of the top, back and side panels to form a display tray having a bottom, and front, back, left and right sides, the edge of the slots forming a finished edge of the top edge of the sides of the display tray.

5. The container of claim 4, wherein the first and second slots extend at least half of the width of the respective sides.

6. The container according to claim 5 wherein after separation of the separation strip, the front, back and left and right sidewalls of the display portion have the same height.

7. A container in combination with at least one product, the combination comprising:

at least one product; and a convertible shipper container constructed around the product, the convertible shipper container configured to package the product for shipping and display the product for marketing, wherein the convertible shipper comprises:

a top panel;

a bottom panel;

a left side including a first slot therethrough extending partially across a width of the left side and a first portion of a separation strip included therein extending collinearly with the first slot across a remainder of the width of the left side, a back panel including a second portion of the separation strip included therein;

a right side including a second slot therethrough extending partially across a width of the right side and a third portion of the separation strip included therein extending collinearly with the second slot across a remainder of the width of the right side; and a partially open front side for viewing the product when the product is packaged within the convertible shipper container, the partially open front comprising a front wall and a window having a perimeter including an upper edge of the front wall, a front edge of the left side, a front edge of the top panel, and a front edge of the right side.

8. The combination of claim 7, wherein the separation strip is configured to be removed from the left side, back panel and right side to separate the container into a disposable portion and a display portion configured to retain and display the product for marketing.

9. The combination of claim 8, wherein the display portion comprises:

the bottom panel;

the front wall, wherein the upper edge has a uniform manufactured surface;

a left side wall including an upper edge having a section with a uniform manufactured finished edge and a section with an unfinished edge;

a back wall including an upper edge having an unfinished edge; and a right side wall including an upper edge having a section with a uniform manufactured finished edge and a section with an unfinished edge.

10. The container of claim 9, wherein the section of the left side wall upper edge with the uniform manufactured finished edge comprises a bottom edge of the first slot, and the section of the left side wall upper edge with the unfinished edge is created when the first portion of the separation strip is removed from the left side.

11. The combination of claim 9, wherein the section of the right side wall upper edge with the uniform manufactured finished edge comprises a bottom edge of the second slot, and the section of the right side wall upper edge with the unfinished edge is created when the third portion of the separation strip is removed from the right side.

12. The combination of claim 9, wherein the unfinished edge of the back wall upper edge is created when the second portion of the separation strip is removed from the back panel.

13. The combination of claim 9, wherein the left side wall upper edge extends from a first end of the front wall upper edge diagonally upward to a first end of the back wall upper edge, and the right side wall upper edge extends from a second end of the front wall upper edge diagonally upward to a second end of the back wall upper edge.

14. The combination of claim 9, wherein the front wall has a uniform height across a width of the front wall, the left side wall has a uniform height across a width of the left side wall, the back wall has a uniform height across a width of the back wall, and the right side wall has a uniform height across a width of the right side wall.

15. The combination of claim 14, wherein the heights of the front wall, the left side wall, the back wall and the right side wall are equal.

16. The combination of claim 14, wherein the heights of at least two of the front wall, the left side wall, the back wall and the right side wall are equal.

* * * * *